US007877965B2

(12) United States Patent
Honegger

(10) Patent No.: US 7,877,965 B2
(45) Date of Patent: Feb. 1, 2011

(54) METHOD AND DEVICE PACKAGING FLAT OBJECTS

(75) Inventor: Werner Honegger, Bach (CH)

(73) Assignee: FERAG AG, Hinwil (CH)

( * ) Notice: Subject to any disclaimer, the term of this patent is extended or adjusted under 35 U.S.C. 154(b) by 0 days.

(21) Appl. No.: 12/826,126

(22) Filed: Jun. 29, 2010

(65) Prior Publication Data

US 2010/0300047 A1 Dec. 2, 2010

Related U.S. Application Data

(63) Continuation of application No. 11/569,885, filed as application No. PCT/CH2005/000278 on May 19, 2005, now Pat. No. 7,757,461.

(30) Foreign Application Priority Data

Jun. 2, 2004 (CH) ..... 0931/04

(51) Int. Cl.
*B65B 9/06* (2006.01)

(52) U.S. Cl. ..... 53/450; 53/463; 53/550

(58) Field of Classification Search ..... 53/447, 53/450, 461, 463, 531, 540, 167, 547, 548, 53/550, 555, 542, 543, 544
See application file for complete search history.

(56) References Cited

U.S. PATENT DOCUMENTS 2,280,405 A * 4/1942 Frostad ..... 53/450
3,007,295 A 11/1961 Heinzer
3,417,544 A * 12/1968 Grevich ..... 53/550
3,932,982 A * 1/1976 Klapp ..... 53/244
4,325,519 A 4/1982 McLean
4,381,637 A 5/1983 Ballestrazzi et al.
4,546,595 A * 10/1985 Yasumune et al. ..... 53/450
4,577,789 A * 3/1986 Hofmann et al. ..... 225/100
4,676,050 A * 6/1987 Odenthal ..... 53/447

(Continued)

FOREIGN PATENT DOCUMENTS

DE 3123988 3/1982

(Continued)

*Primary Examiner*—Paul R Durand
(74) *Attorney, Agent, or Firm*—Rankin, Hill & Clark LLP

(57) ABSTRACT

In order to package flat objects (1) with the aid of a quasi-endless packaging material web, the packaging material web is placed around a row (4) of the objects (1), in which these objects are conveyed one after the other and in an interspaced manner, whereupon longitudinal seams are made in the packaging material web and transversal seams are made between the objects (1) whereby separating the packaged objects from one another. In contrast to prior art packaging methods during which the row is formed before the packaging material web is fed thereto, the invention provides that the row is directly formed on the packaging material web (2) during which the objects are, by acceleration, separated out from a supply stream (3), in which they are fed while overlapping one another, and directly placed upon or pushed onto the packaging material web (2). Forming the row (4) directly on the packaging material web (2) eliminates additional conveying steps whereby shortening the entire required conveyor lines and rendering stabilizing means for stabilizing the objects (1) during conveyance unnecessary thus leading to very compact and simple packaging devices. The packaging method is particularly suited for packaging objects that consist of a number of stacked printed products or other flat articles.

11 Claims, 4 Drawing Sheets

U.S. PATENT DOCUMENTS

| | | | | | |
|---|---|---|---|---|---|
| 4,876,842 | A | | 10/1989 | Ausnit | |
| 4,947,623 | A | | 8/1990 | Saito et al. | |
| 5,255,495 | A | * | 10/1993 | Kovacs | 53/504 |
| 5,351,464 | A | | 10/1994 | Francioni | |
| 5,566,526 | A | * | 10/1996 | Suga | 53/75 |
| 5,588,285 | A | * | 12/1996 | Odenthal | 53/534 |
| 5,689,942 | A | * | 11/1997 | Suga | 53/550 |
| 5,706,635 | A | * | 1/1998 | Simmons | 53/511 |
| 5,941,053 | A | * | 8/1999 | Kotsiopoulos | 53/435 |
| 6,122,898 | A | * | 9/2000 | De Kort | 53/450 |
| 6,964,150 | B2 | | 11/2005 | Battisti | |
| 6,973,766 | B2 | * | 12/2005 | Klapp et al. | 53/542 |
| 7,225,601 | B2 | * | 6/2007 | Spatafora | 53/542 |
| 7,263,815 | B2 | * | 9/2007 | Ballestrazzi et al. | 53/450 |
| 2002/0095913 | A1 | | 7/2002 | Honegger | |
| 2009/0229228 | A1 | * | 9/2009 | Sambugaro | 53/550 |

FOREIGN PATENT DOCUMENTS

| | | |
|---|---|---|
| EP | 0018041 | 10/1980 |
| EP | 0084299 | 7/1983 |
| EP | 0587527 | 3/1994 |
| EP | 0712782 | 5/1996 |
| EP | 1375399 | 1/2004 |
| GB | 2135978 | 9/1984 |
| JP | 54-145582 | 10/1979 |

* cited by examiner

METHOD AND DEVICE PACKAGING FLAT OBJECTS

This application is a continuation of U.S. Ser. No. 11/569,885 filed on Jan. 2, 2007 and currently pending, which is a national stage application of PCT/CH2005/000278, filed on May 19, 2005.

BACKGROUND OF THE INVENTION

1. Field of the Invention

The invention lies in the field of packaging technology and relates to a method and to an installation. The method and installation serve for packaging flat objects, for example individual printed products, stack-like groups of printed products, or stack-like groups of printed products and other flat items, such as for example CDs, flat product samples or flat sample bags.

2. Description of Related Art

It is known to package flat objects of the above mentioned type with the help of a quasi endless packaging material web (e.g. plastic film or paper web supplied from the roll). Thereby, such a packaging material web is folded around a row of the objects, in which the objects are conveyed one after the other and distanced from each other. Alternatively, two packaging material webs are supplied to such a row, one from each side. The packaging material web (or webs) is then closed around the row in longitudinal seams on the upper side of the row or laterally thereto, and in transverse seams between each two successive objects. As the case may be, the objects which are such enclosed on all sides by packaging material are separated from one another directly after the transverse seams are made or simultaneously with the making of these seams.

If a plastic film is used as packaging material, the longitudinal and transverse seams are usually made by welding, wherein the separation of the packaged objects may be carried out simultaneously with the welding. If the packaging material is paper, an adhesive to be activated by heat may be deposited onto the packaging material in the locations of the longitudinal and transverse seams, directly before the web is supplied to the row of objects to be packed. The seams are then made with similar means as used for welded seams on plastic packaging material. It is also possible to close the seams by way of embossing or by way of other known methods which are matched to the packaging material which is used.

Devices for implementing packaging as mentioned above are for example disclosed in the publications EP-01712782, DE-3123988 or EP-0018041.

As disclosed in these publications, the objects are supplied to be packaged lying loosely on a conveyor surface (e.g. conveyor belt) in a row, in which they are arranged one after the other and distanced from one another. The distances between successive objects is adapted to the thickness of the objects and to the applied methods for making the transverse seams and for separating the packaging material. For maintaining the exact arrangement of the objects in the row, conveyor cams are used in addition to the conveyor surface, by way of which the flat objects can be supplied in a more accurately cycled manner than would be the case with the conveyor surface as a sole conveyor means. The quasi endless packaging material web is then supplied to the row of flat objects either from below through a gap in the conveyor surface or from above, wherein the packaging material web has the same speed as the row of the objects.

For creating the row, the objects are usually separated from a stack and laid individually onto the conveyor surface.

In practice, the mentioned packaging method including establishing and supplying the object row requires a relatively long conveyor path, which for reasons of available space can in many cases only be realised including changes in the conveying direction. In such direction changes, acceleration forces not only effect the flat objects in a disorientating manner, but also have a destabilising effect on objects, in particular if these objects are stacks of a plurality of flat items. Additionally, when the conveying capacities are high, there are high conveyor speeds and due to this, high air resistances, which have the same effect on the objects. In order to be able to counteract such effects, extensive measures are necessary on the part of the installation, by way of which the required conveyor paths are usually extended even more.

It is, therefore, the object of the invention to create a method and an installation which serve for packaging a row of flat objects with the help of a quasi endless packaging material web, and with which the disadvantages of known such methods and installations as described above can be avoided. In particular, the method and installation according to the invention are to enable limitation of the conveyor paths to a minimum length, and to make do with the simplest of conveyor means, and despite of this to be able to package at high conveyor performance even objects having only little stability.

BRIEF SUMMARY OF THE INVENTION

This object is achieved by the method and the installation as defined in the patent claims.

The basic idea of the invention is to not establish the row of objects to be packaged first and then to convey this row lying on a conveyor surface to the quasi endless packaging material, as in known packaging methods of the type, but to establish the row directly on or below the packaging material web. This means that according to the invention it is not a row of objects arranged one after the other in the conveying direction and distanced from one another, which is supplied to the packaging, but it is a supply stream in which the distances of the objects from one another are smaller than their length in the conveying direction, which they have when conveyed in the row. The supply stream is, thus for example, an imbricated stream lying on the conveyor surface, in which stream the objects are conveyed overlapping one another. Or it is a gripper stream in which the objects are held individually in an edge region, and are conveyed at small distances between each other. From this supply stream, the objects are individualized in succession by being accelerated, and they are positioned directly on or below the packaging material web which is transported in a web direction. Such deposition is achieved for example by laying the objects down on the web or by pushing them onto the web.

The ratio between the web speed and the supply speed and thus the required object acceleration for separating the objects from the supply steam and positioning them on the packaging material web, is determined by the object distances in the supply stream and by the object length and object distances in the row to be established on the packaging material web.

The web direction is essentially horizontal, such that flat objects lying on the packaging material web and being held by gravity against the packaging material web, remain in the position on the web in which they are positioned on acceleration. If the flat objects are supplied in an imbricated stream, it is advantageous to arrange the supply direction in the same vertical plane as the web direction and roughly horizontal, and to divert the packaging material from below or from above into the web direction at the acceleration location. If the flat objects are supplied in a gripper stream, it is advantageous to direct these from above or below towards the packaging material web moving in the web direction, and to divert them into the web direction directly above or below the packaging material web.

It is observed that with the method according to the invention, relatively unstable, flat objects such as for example stacks of a plurality of printed products with different formats, can be positioned on a plastic film and supplied to the seam making, with conveyor capacities of more than 40,000 pieces per hour without the need for additional means for stabilizing the objects. Therein, the path between the individualization and positioning and the seam making is determined solely by the type of web and the manner in which the web is arranged round the row, and may be reduced even further with the use of two webs.

BRIEF DESCRIPTION OF THE DRAWINGS

The method and the installation according to the invention are described in detail in connection with the following Figs., wherein:

(FIG. 1: side view, FIG. 2: plan view);

DETAILED DESCRIPTION OF THE INVENTION

Figure 1:
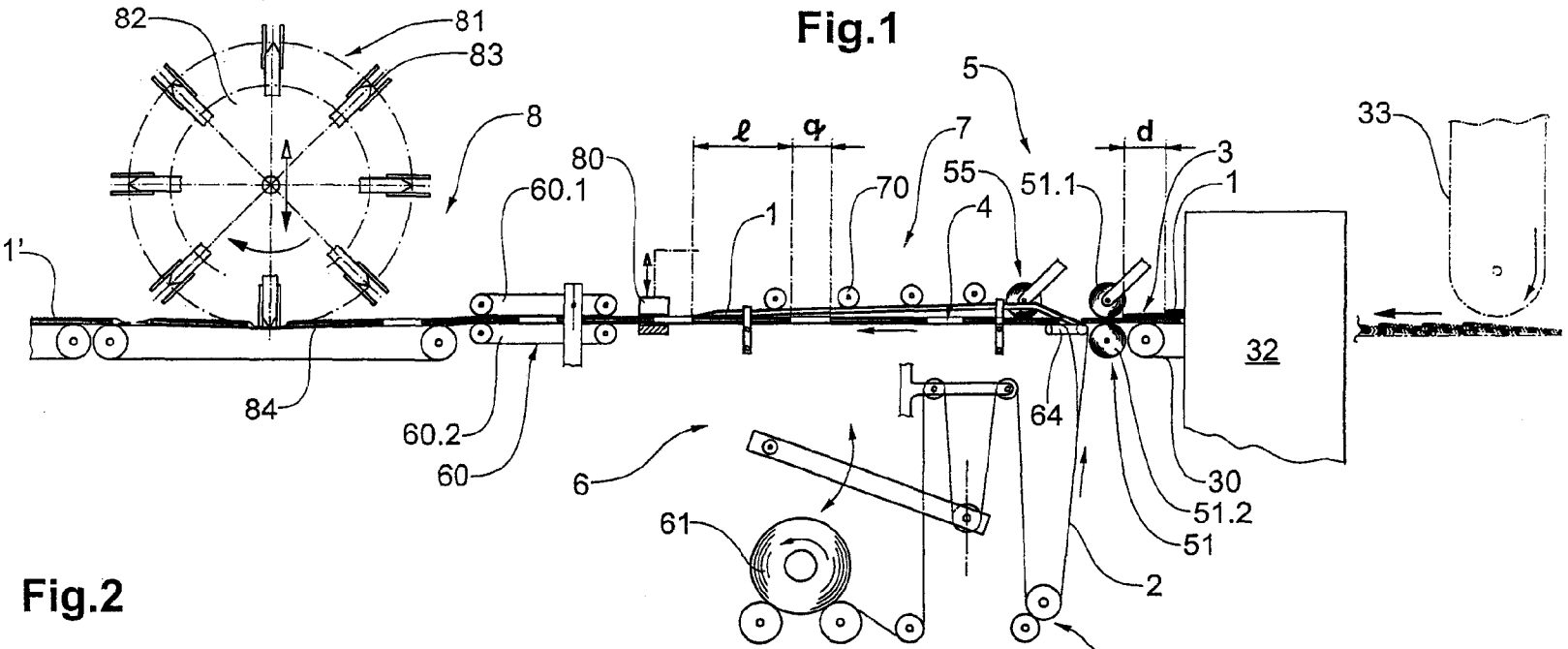
FIGS. 1 and 2 are schematic diagrams of an exemplary embodiment of an installation according to the invention, which serve for explaining the basic principles of the method according to the invention
Figure 2:
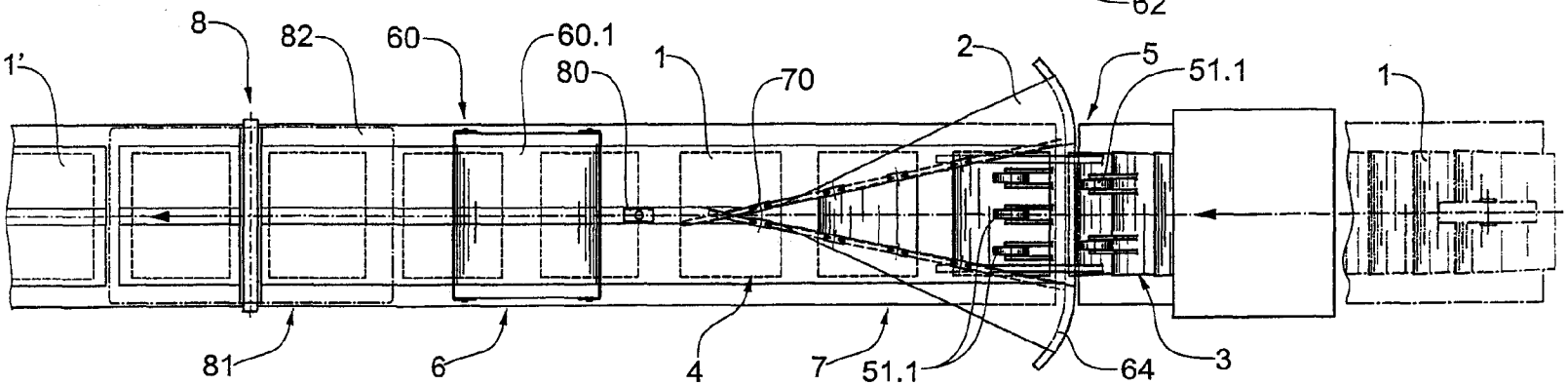

FIGS. 1 and 2 show an exemplary embodiment of the method and the installation according to the invention. As already initially explained, these serve for packaging flat objects 1 with the help of a quasi endless packaging material web 2. The objects are supplied in a supply stream 3 (here an imbricated stream) and they are positioned one after the other on the packaging material web 2 in a manner such that they form a row 4 on the packaging material web. The objects are conveyed in the supply stream 3 at distances d from each another, wherein d is smaller than the object length 1 in the conveying direction. For the transverse seams, a distance q is to be established between the objects 1 conveyed one after the other in the row 4.

The installation comprises essentially the following four devices which cooperate with one another: a first device 5 for establishing the row, which means according to the invention for separating the objects 1 from the supply stream 3 by acceleration and for positioning them directly on (or below, see FIG. 7) the packaging material web 2, a second device 6 for supplying the packaging material web 2 and for transporting the packaging material web 2 together with the row 4, a third device 7 for folding the packaging material web 2 around the row 4 (or for supplying a further packaging material web, see FIG. 6) and a fourth device 8 for making the seams and, as the case may be, for separating the packaged objects 1' from one another.

The first device 5 for establishing the row 4 comprises acceleration means 51, by way of which objects are successively accelerated from the head end of the supply stream 3, and thereby are separated from this head end, i.e. individualized, and simultaneously positioned on the packaging material web. The acceleration means 51 is, for example, a pair of an upper and a lower acceleration roller 51.1 and 51.2 or a plurality of such pairs. Instead of the acceleration rollers 51.1 and 51.2, suitably arranged revolving acceleration belts or cam wheels may be used.

The second device 6 for supplying the packaging material web 2 and for transporting this web together with the row 4, comprises a drawing means 60 for continuously drawing the packaging material web 2 off a supply roll 61 and moving it in the web direction, as well as a tensioning means 62 for maintaining the packaging material web under a constant tension. The drawing means 60 is advantageously arranged where the packaging material 2 is already folded around the row 4, i.e. downstream of the third device 7. For being able to perform its drawing function without having to change the direction of the web movement, the drawing means 60 is designed for example as a cooperating pair of an upper and lower tensioning belt 60.1 and 60.2, wherein the two tensioning belts press from above and below onto the row 3 wrapped in the packaging material web, and at least one of the tensioning belts is driven at web speed. Instead of the tensioning belts 60.1 and 60.2, suitable drawing rollers are also applicable. The tensioning means 62 is arranged upstream of the location at which the objects to be packaged are positioned on or below the packaging material web, and consists, for example, of a pair of tension rollers. Furthermore, the second device 6 of the embodiment according to FIGS. 1 and 2 comprises direction changing means 64 (e.g. a diversion bar), by way of which the packaging material web is redirected into the web direction in the active region of the acceleration means 51.

The third device 7 for folding the packaging material web 2 around the row 4 (or according to FIG. 6, for supplying a further packaging material web), acts upstream of the drawing means 60, between this and the direction changing means 64, wherein the direction changing means itself may already have a folding-over effect on the packaging material web 2, e.g. by being designed as an arcuate direction changing bar. The third device 7 comprises, for example, in a per se known manner a sequence of pairs of folding-over rollers 70 arranged above the row 4, wherein the distance between the fold-over rollers 70 of the pairs becomes smaller in the web direction, so that the two longitudinal edges of the packaging material web 2 are guided towards each other above the row 4. Corresponding devices with which the longitudinal edges of a packaging material web arranged above the row are guided together underneath the row (see FIG. 7) are also known. It is, of course, also possible not to deposit the row 4 in the middle of the packaging material web 2, but on one side thereof, and to fold the packaging material web around the row only from one side.

The fourth device 8 for making the seams comprises a means 80 for making the longitudinal seam and a means 81 for making the transverse seams. As shown in the FIGS. 1 and 2, the means 80 for making the longitudinal seams is advantageously arranged upstream of the drawing means 60 and the means 81 for making the transverse seams downstream thereof. Any known such means which are suitable for connecting the packaging material in seams may be applied as means 80 and 81. Suitably designed and arranged welding heads are in particular useful when a plastic film is used as packaging material. In particular, a rotating arrangement 82 of welding heads 83 which cooperate with a counter pressing belt 84 are suitable as means 81 for making the transverse seams. Such an arrangement is described in detail in a patent application which has the same application date as the present application.

Per se known methods may be applied for establishing the supply stream 3, which is not part of the invention. For example, an imbricated stream may be deposited on a supply belt 30 using a feeder 32 which takes the objects from a stack, using a winding station, which takes the objects from a reel, using a gripper conveyor 33 which brings the objects directly from a rotation printing machine. In the latter case in which a high output stream is to be processed, the gripper stream is advantageously guided in a looped manner such that two or more parallel imbricated streams can be deposited. Objects deposited in such parallel imbricated streams can be individualized and positioned according to the invention on the same packaging material web, and subsequently packaged as parallel rows. In such a case, it is necessary to use an adequately wide packaging material web and to provide means for making an additional longitudinal seam between the parallel rows.

Figure 3:
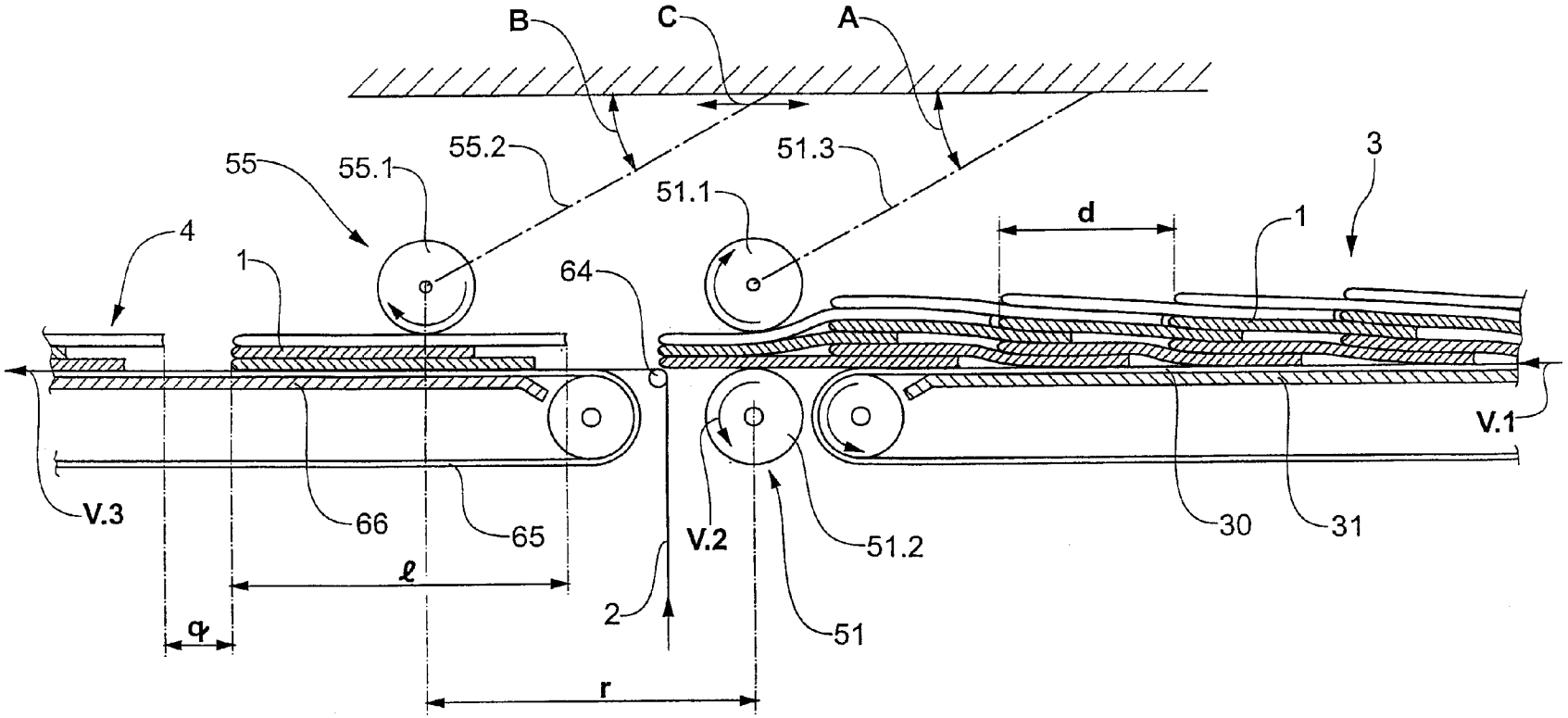
FIG. 3 shows in a somewhat larger scale than in FIGS. 1 and 2, the step of separating the objects from the supply stream by accelerating them and of positioning them on the packaging material web.

FIG. 3, in a somewhat larger scale than FIGS. 1 and 2, shows the step of separating the objects 1 from the supply stream by accelerating them and of positioning them directly on the packaging material web 2. The same elements are designated with the same reference numerals as in the FIGS. 1 and 2.

The supply stream 3 consists in this case of three imbricated streams which are superimposed and in each of which one item type (represented by different hatchings) is supplied. The three imbricated streams are matched and synchronised to one another in a manner such that the items are conveyed with the same distances d from one another in all imbricated streams, and that the leading edges of the items of all imbricated streams are aligned to each other. In this manner, the flat objects 1 are preformed in the superimposed imbricated streams, and in each case consist of three items whose leading edges are aligned to one another and of which in each case one belongs to each one of the imbricate streams. These objects 1 are shown on the left of FIG. 3 lying on the packaging material web 2 in the row 4. The flat objects 1 in the supply stream 3 may also be arranged in a manner simply overlapping one another, without any need for adaptation of the method or the installation according to the invention.

The supply stream 3 is supplied by way of a supply belt 30 at a supply speed v.1. The supply belt 30 may be further supported by a support surface 31. On the head end of the supply belt 30, the acceleration means 51 is arranged, which comprises an upper and a lower acceleration roller 51.1 and 51.2. Of the acceleration rollers, the lower one is for example driven at a peripheral speed v.2, whilst the upper one is arranged in a freely rotating manner, for example on a pivotable (double arrow A) lever 51.3, in a manner such that it is biased by way of its weight or by the force of a suitably arranged spring, against the lower acceleration roller 51.2. It is also possible to drive both acceleration rollers at the peripheral speed v.2.

Downstream of the accelerating means follows the direction changing means 64 which diverts the packaging material web into the web direction which is a substantially straight-lined continuation of the supply direction. The packaging material web 2 is transported by the drawing means (not shown in FIG. 3) at a speed v.3 (web speed) away from the acceleration means 51, wherein it is supported by a support conveyor 65 and/or a support surface 66.

The speed ratio v.3:v.1 (web speed to supply speed) equals the ratio d:(1+q). The speed v.2 (peripheral speed of the acceleration rollers) is at least as large as v.3. By way of this, it is ensured that a frontmost object in the supply stream is completely separated therefrom, before a following object comes into the active region of the acceleration means 51. In the same way it is ensured that the accelerated object can be securely positioned on the packaging material web. Positioning is supported in the shown case by gravity, which holds the objects against the packaging material web. Positioning may additionally be supported by a positioning aid 55 which acts on each newly positioned object 1 by pressing it onto the packaging material web. The positioning aid 55 is, for example, an auxiliary roller 55.1 which is arranged on a pivotable (double arrow B) lever 55.2 in a freely rotating manner, and in a manner such that it rolls on the packaging material web or on the objects positioned thereon, while being biased downwards by its weight or by a suitably arranged spring. The auxiliary roller 55.1 may also be driven at the web speed v.3.

The distance r between the acceleration means 51 and the positioning aid 55 is roughly the same as the length l of the objects. Advantageously, the distance r can be adjusted for adaptation to different object lengths l, for example by a displacement of the pivot lever 55.2 (double arrow C).

The acceleration rollers 51.1 and 51.2 as well as the auxiliary roller 55.1 may be designed as one roller each, which roller has an axial length roughly as large as the width of the objects 1 to be packaged. Advantageously however, each one is designed as a plurality of coaxial part-rollers displaceable transverse to the web direction, in a manner such that they are able to be positioned depending on format and shape of the objects to be packaged. With such displaceability the rollers can, for example, be prevented from acting on fold edges of the objects and therewith from damaging these fold edges. Such a design of the acceleration and auxiliary rollers is evident from FIG. 2, in which in each case two acceleration part-rollers and three auxiliary part-rollers are shown.

Figure 4:
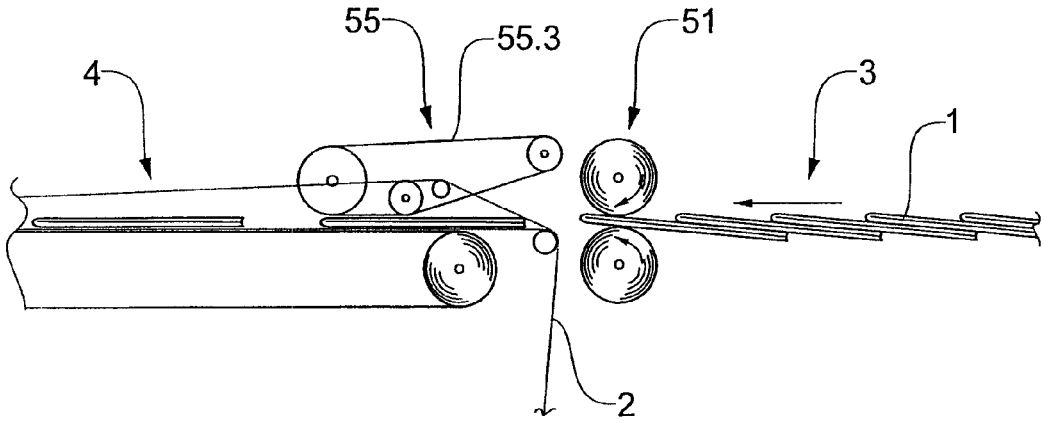
FIGS. 4 and 5 show the step of separating and positioning as FIG. 3, but using other positioning means.
Figure 5:
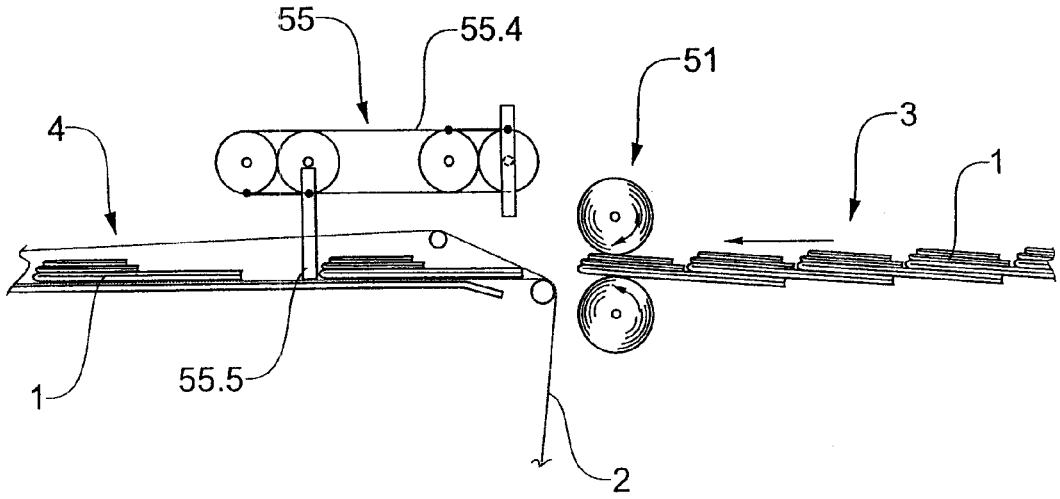

FIGS. 4 and 5 show two further embodiments of the steps of separating the objects 1 from the head end of the supply stream 3 and of positioning them on the packaging material web 2 to form the row 4 on this web. The two embodiments differ from the embodiment according to FIGS. 1 to 3 in particular by way of differently designed positioning aids 55.

FIG. 4 shows a positioning aid 55 in the form of an auxiliary belt 55.3 which is driven advantageously at the speed v.3 (web speed) and which may be designed in a similar manner as the auxiliary roller 55.1 of FIG. 3, as a plurality of part-belts displaceable transversely to the web direction. FIG. 5 shows a positioning aid 55 in the form of a cam conveyor 55.4 with cams 55.5, said cam conveyor acting from above on the positioned objects 1. The cams are arranged on a conveyor member at distances from each other equal to I+q. The cams are driven at the web speed v.3 and are synchronised with the supply stream 3 in a manner such that they act in an aligning manner on the leading edges of the objects 1 positioned on the packaging material web. The cams 55.5 comprise advantageously a plurality of part-cams-acting in parallel, in the same manner as the auxiliary roller according to FIG. 3 and the auxiliary belt according to FIG. 4.

A further difference between the embodiments of the method according to the invention represented in FIGS. 4 and 5 concerns the supply stream 3. Whilst the supply stream 3 according to FIG. 4 is a simple imbricated stream of flat objects, the supply stream according to FIG. 5 comprises a plurality of superimposed part streams. Not all of these part streams are imbricate streams as in FIG. 3, but they consist partly of flat items which are conveyed one after the other, because they obviously have a length in the conveyor direction which is not as large as the distances between the objects (groups of in each case one item from each part stream) to be packaged. Evidently, it is of no relevance to the method according to the invention as to the nature of the supply stream 3 and the objects to be packaged, as long as in the supply stream, the distances between the objects to be packaged is smaller than the length of the longest item in each object, such that the supply speed v.1 is smaller than the web speed v.3.

Figure 6:
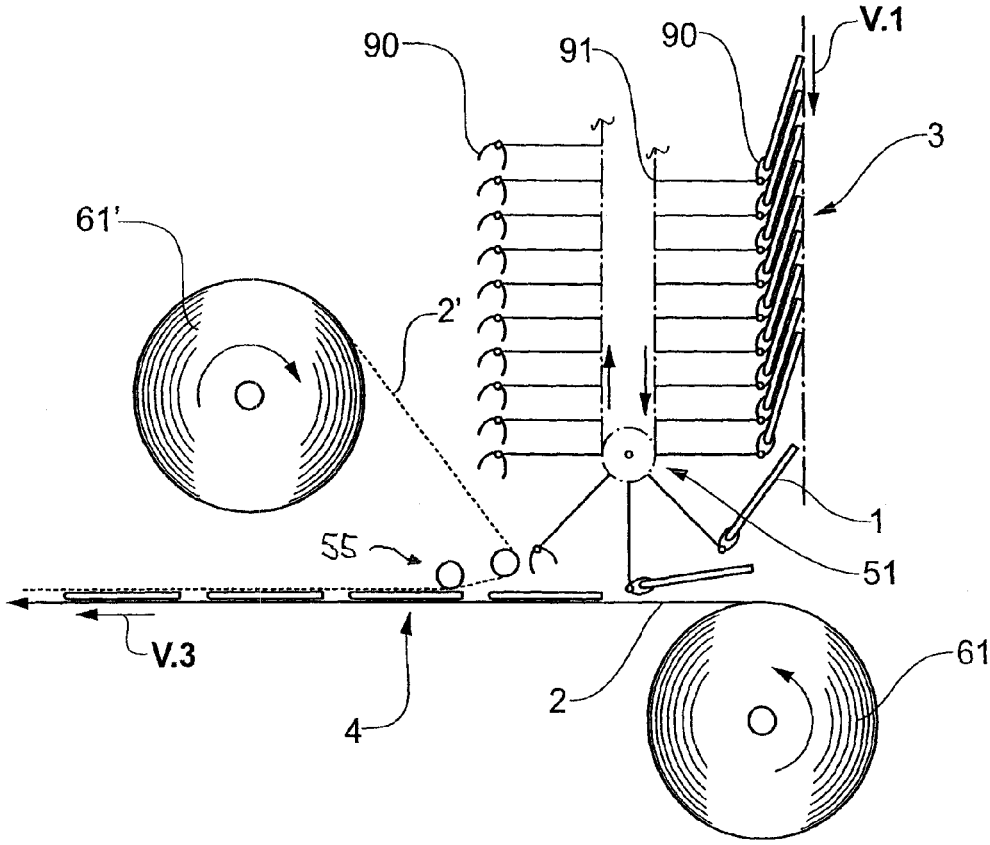
FIG. 6 shows a further embodiment of the step of separating the objects from the supply stream by acceleration, and of positioning them on the packaging material web.

FIG. 6 very schematically shows a further exemplary embodiment of the step of separating by acceleration the objects to be packaged from the supply stream 3, and of positioning them on the packaging material web 2. The supply stream 3 in this embodiment is a gripper stream directed from above against the packaging material web 2, which is transported in the web direction, wherein the gripper stream changes direction above the web. In this gripper stream, each object 1 is conveyed being held by a gripper 90, and, along a straight conveyor path, the distances between the grippers 90 are smaller than the object lengths. The grippers 90 are arranged on a conveyor member, e.g. on a gripper chain (dot-dashed line 91) cantilevered from this member in such a manner that on changing direction, the grippers are accelerated in a manner such that they achieve the web speed v.3 or that their distance is increased to l+q respectively. The change of direction in the gripper stream is therefore able to act as acceleration means 51. This means that the grippers 90 and the objects 1 held by them are successively accelerated from v.1 to v.3 in the location of the direction change and are therewith individulaized, to be positioned on the packaging material web 2 being transported past and below the direction changing location, wherein for positioning the grippers 90 are opened one after the other.

The grippers 90, instead of being arranged on a conveyor member may also be arranged on a suitable conveyor element each, wherein the conveyor elements are able to be conveyed independently of one another. In such case, the dot-dash line 91 of FIG. 6 is to be understood as a rail for the conveyor elements and the direction change location is, for example, designed as a cycle wheel. The grippers 90 are arranged cantilevered on the conveyor elements in the same manner as this is the case for a corresponding conveyor member.

For rendering the installation according to FIG. 6 adaptable to different object lengths l, the projection of the grippers from the conveyor member or element and/or the direction change geometry (radius, angle) is to be adjustable.

FIG. 6 shows that with the shown supply, individualization and positioning, it becomes possible to design the installation in an even more compact manner than according to FIGS. 1 to 5, in particular if, in place of folding the packaging material web 2 around the row of objects, a further such web 2' is supplied from above from a further supply roll 61'. Therein a means for diverting the additional packaging material web into the web direction may simultaneously function as a positioning aid 55.

Figure 7:
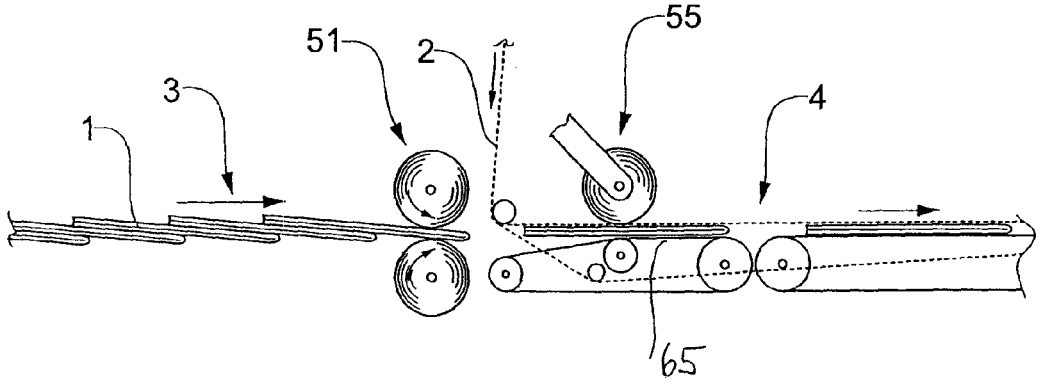
FIG. 7 shows a further embodiment of the step of separating the objects from the supply stream by acceleration, and of positioning them below the packaging material web which in this case is supplied from above.

FIG. 7 shows a further embodiment of the step of separating the flat objects 1 to be packaged from the supply stream and of positioning them, wherein in this case the packaging material web 2 is diverted from above into the web direction in the active region of the acceleration means 51, and the objects 1 are positioned below the packaging material web 2, which is to say between the packaging material web 2 and the support conveyor 65. The positioning aid 55 may also be applied in this case. The folding of the packaging material web 2 arranged above the row 4, around the row 4 is known from the state of the art and for this reason is not described further here.

What is claimed is:

1. A method for arranging a row (4) of flat objects (1), comprising the steps of:

conveying the flat objects (1) one after the other and spaced apart from one another in a row (4) on a conveying surface (2) in a web direction, supplying the objects (1) in a supply stream (3) in which the distances (d) between objects are smaller than object lengths (l) in the web direction of the objects (1) when conveyed in the row (4), wherein the distance (d) is the distance between leading edges of two neighbouring flat objects (1), and wherein the supply stream (3) is a gripper stream in which each object (1) is held by a gripper (90) and conveyed from above toward the conveying surface (2), and positioning the objects (1) individually and successively by means of acceleration directly upon the conveying surface (2), wherein in a deflection position, the gripper stream is deflected above the conveying surface (2) in a web direction and the objects (1) are thus accelerated, and wherein the objects (1) are deposited upon the conveying surface (2) by the grippers (90) opening, so that the row (4) is established directly on the conveying surface (2).

2. The method according to claim 1, wherein the conveying surface (2) is a quasi endless web of packaging material and wherein the packaging material web (2) is folded around the row (4) or a further packaging material web (2') is laid upon or below the row (4), wherein at least one longitudinal seam is established along the conveyed row (4) covered on either side by packaging material, and transverse seams are established between successive objects in the row, so that each object becomes enveloped by packaging material on all sides.

3. The method according to claim 1, wherein the objects (1) are successively separated from a head end of the supply stream (3) by acceleration.

4. The method according to claim 1, wherein the objects (1) are conveyed in the gripper stream overlapping one another.

5. The method according to claim 1, wherein the grippers (90) are arranged on a conveying organ or on conveying elements, which can be conveyed independently of each other, in such a projecting manner that they are accelerated in the deflection position in such a manner that their distance is increased to (l+q), wherein (l) is the length in the web direction of the objects conveyed in the row (4).

6. The method according to claim 5, wherein the distance between the grippers (90) is shorter than the object length (l) in a first part of the conveying path and greater than the object length (l) in a second part of the conveying path.

7. The method according to claim 1, wherein the objects are deposited on the conveying surface (2) passing beneath the deflection position through the controlled serial opening of the grippers (90).

8. The method according to claim 1, wherein each object (1) is a printed product or a stack-like arrangement of a plurality of flat objects, of which at least some are printed products.

9. An installation for conveying flat objects (1), which installation comprises:

a first device (5) for establishing a row (4) of objects (1), in which row the objects are arranged one after the other and spaced apart from one another, as well as a second device (6) for supplying a conveying surface (2) and for conveying the conveying surface (2) together with the row (4) in a web direction, wherein the first device (5) is preceded by a means of supply wherewith a supply stream can be supplied, in which the distances (d) between the objects are shorter than their lengths (l) in web direction, wherein the distance (d) is the distance between leading edges of two neighbouring flat objects (1), wherein the means of supply is a gripper conveyor with grippers (90) arranged on a conveying organ (91) or on conveying elements, which can be conveyed independently of each other, and that the first device (5) comprises a means of acceleration (51), wherein the acceleration means (51) is equipped and arranged for an acceleration of the object of the supply stream (3), and that the acceleration means (51) is further equipped and arranged for the direct positioning of each accelerated object (1) upon the conveying surface (2), wherein the acceleration means (51) is a deflection of the gripper conveyor, wherein each gripper is equipped for the gripped conveying of an object (1), and wherein the gripper conveyor is arranged guiding from above toward the conveying surface (2) moving in web direction and the deflection of the gripper conveyor occurs above the material web (2), and wherein a means of control is provided, which is equipped for the serial opening of the grippers (90) in the region of the deflection.

10. The installation according to claim 9, wherein the grippers (90) on the conveying organ or on the conveyor elements are arranged at such projections that they are accelerated, when deflected, in such a way that the distance between them increases to (l+q), wherein (l) is the length in web direction of the objects conveyed in the row (4).

11. The installation according to claim 9, wherein the deflection is a deflection of a head end of the supply stream, from which the objects (1) are successively individualized through acceleration.

* * * * *